US006662381B1

(12) United States Patent
Powell et al.

(10) Patent No.: US 6,662,381 B1
(45) Date of Patent: Dec. 16, 2003

(54) AUTOMATED TOILET PLUNGING APPARATUS

(76) Inventors: Elizabeth C. Powell, P.O. Box 1105, Lakeland, FL (US) 33802-1105; Latasha Powell, P.O. Box 1105, Lakeland, FL (US) 33802-1105

( * ) Notice: Subject to any disclaimer, the term of this patent is extended or adjusted under 35 U.S.C. 154(b) by 0 days.

(21) Appl. No.: 10/340,719

(22) Filed: Jan. 13, 2003

(51) Int. Cl.[7] ..... E03D 9/00
(52) U.S. Cl. ..... 4/255.01; 4/255.05; 4/255.07
(58) Field of Search ..... 4/255.01, 255.02, 4/255.03, 255.04, 255.05, 255.06, 255.07, 255.08, 255.09, 255.11, 255.12, 233; 15/104.31, 406

(56) References Cited

U.S. PATENT DOCUMENTS 4,144,598 A * 3/1979 Li ..... 4/255.06
4,445,236 A * 5/1984 Nadolny et al. ..... 4/255.01
5,321,858 A 6/1994 Anderson
5,353,442 A 10/1994 Rotter
5,384,918 A * 1/1995 Leighton et al. ..... 4/255.05
5,600,856 A 2/1997 Kang
D385,073 S 10/1997 Tash
5,852,834 A 12/1998 Harvey
5,963,994 A 10/1999 Harvey

* cited by examiner

*Primary Examiner*—Gregory L. Huson
*Assistant Examiner*—Azy Kokabi

(57) ABSTRACT

An automated toilet plunging apparatus for unclogging and unplugging a plugged toilet drain. The automated toilet plunging apparatus includes a toilet having a bowl and also having a drain disposed through a bottom of the bowl; and also includes a plunger housing assembly including a container being securely disposed in the bowl and having an open front side, and also including a door being hingedly attached to the container and being openly closed upon the open front side of the container; and further including a plunger member being removably disposed in the container for opening a plugged drain; and also including an assembly of actuating the plunger member; and also including a hose being attached to the plunger member and being adapted to be connected to a water supply for rinsing the bowl when the plunger member is positioned over the drain.

9 Claims, 5 Drawing Sheets

AUTOMATED TOILET PLUNGING APPARATUS

BACKGROUND OF THE INVENTION

1. Field of the Invention

The present invention relates to built-in toilet plungers and more particularly pertains to a new automated toilet plunging apparatus for unclogging and unplugging a plugged toilet drain.

2. Description of the Prior Art

The use of built-in toilet plungers is known in the prior art. More specifically, built-in toilet plungers heretofore devised and utilized are known to consist basically of familiar, expected and obvious structural configurations, notwithstanding the myriad of designs encompassed by the crowded prior art, which have been developed for the fulfillment of countless objectives and requirements.

Known prior art includes U.S. Pat. No. 5,852,834; U.S. Pat. No. 4,445,236; U.S. Pat. No. 5,963,994; U.S. Pat. No. 5,321,858; U.S. Pat. No. 5,353,442; U.S. Pat. No. 5,600,856; and U.S. Pat. No. Des. 385,073.

While these devices fulfill their respective, particular objectives and requirements, the aforementioned patents do not disclose a new automated toilet plunging apparatus. The prior art includes manual plungers being used to unplug toilet drains.

SUMMARY OF THE INVENTION

The general purpose of the present invention, which will be described subsequently in greater detail, is to provide a new automated toilet plunging apparatus which has many of the advantages of the built-in toilet plungers mentioned heretofore and many novel features that result in a new automated toilet plunging apparatus which is not anticipated, rendered obvious, suggested, or even implied by any of the prior art built-in toilet plungers, either alone or in any combination thereof. The present invention includes a toilet having a bowl and also having a drain disposed through a bottom of the bowl; and also includes a plunger housing assembly including a container being securely disposed in the bowl and having an open front side, and also including a door being hingedly attached to the container and being openly closed upon the open front side of the container; and further including a plunger member being removably disposed in the container for opening a plugged drain; and also including an assembly of actuating the plunger member; and also including a hose being attached to the plunger member and being adapted to be connected to a water supply for rinsing the bowl when the plunger member is positioned over the drain. None of the prior art includes the combination of elements of the present invention.

There has thus been outlined, rather broadly, the more important features of the automated toilet plunging apparatus in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new automated toilet plunging apparatus which has many of the advantages of the built-in toilet plungers mentioned heretofore and many novel features that result in a new automated toilet plunging apparatus which is not anticipated, rendered obvious, suggested, or even implied by any of the prior art built-in toilet plungers, either alone or in any combination thereof.

Still another object of the present invention is to provide a new automated toilet plunging apparatus for unclogging and unplugging a plugged toilet drain.

Still yet another object of the present invention is to provide a new automated toilet plunging apparatus that is easy and convenient to use.

Even still another object of the present invention is to provide a new automated toilet plunging apparatus that eliminates having to use a handheld plunger and also eliminates the mess of using a handheld plunger and also prevents the clogging material from settling in the drain before a user can apply a handheld plunger to the drain.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
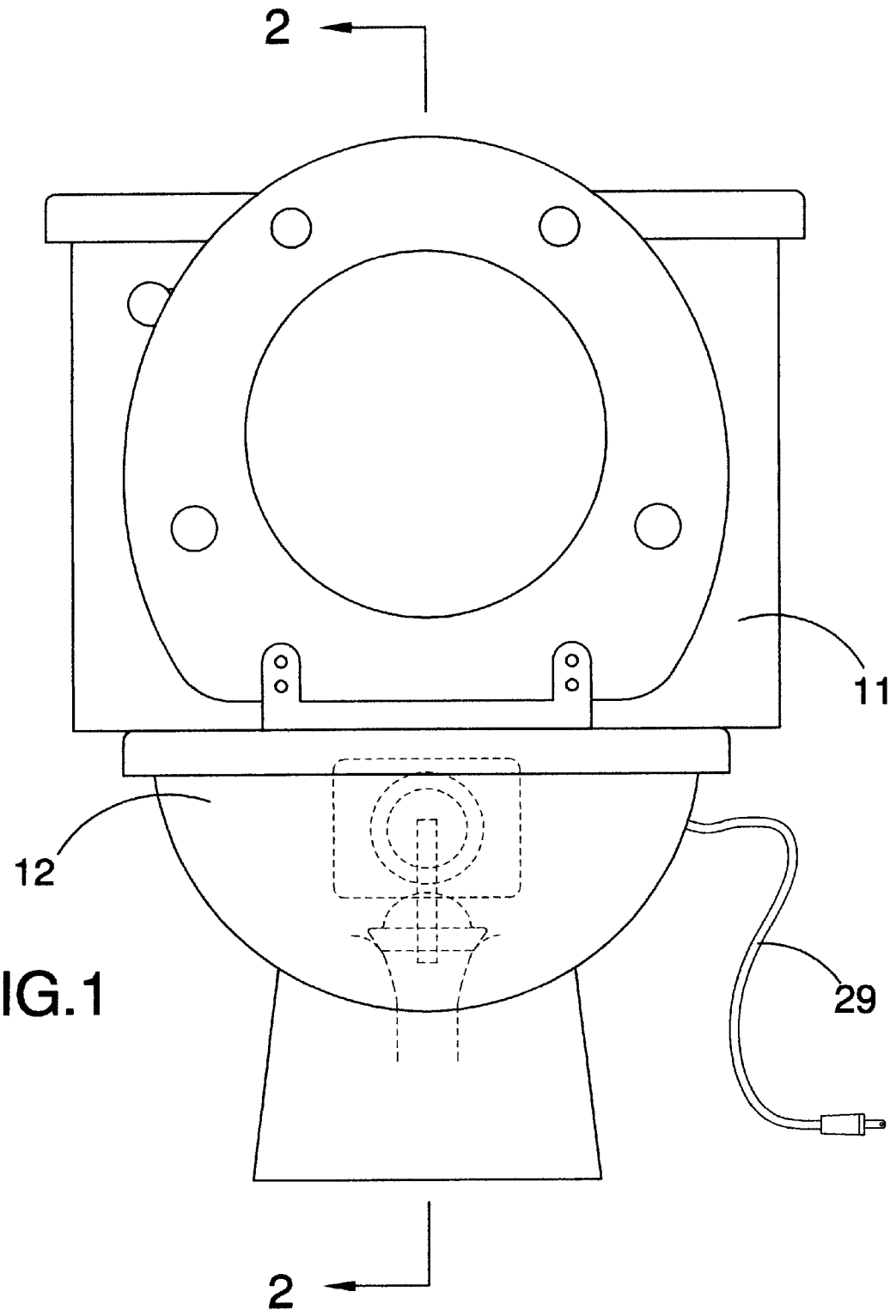
FIG. 1 is a front elevational view of a toilet of a new automated toilet plunging apparatus according to the present invention.
Figure 2:
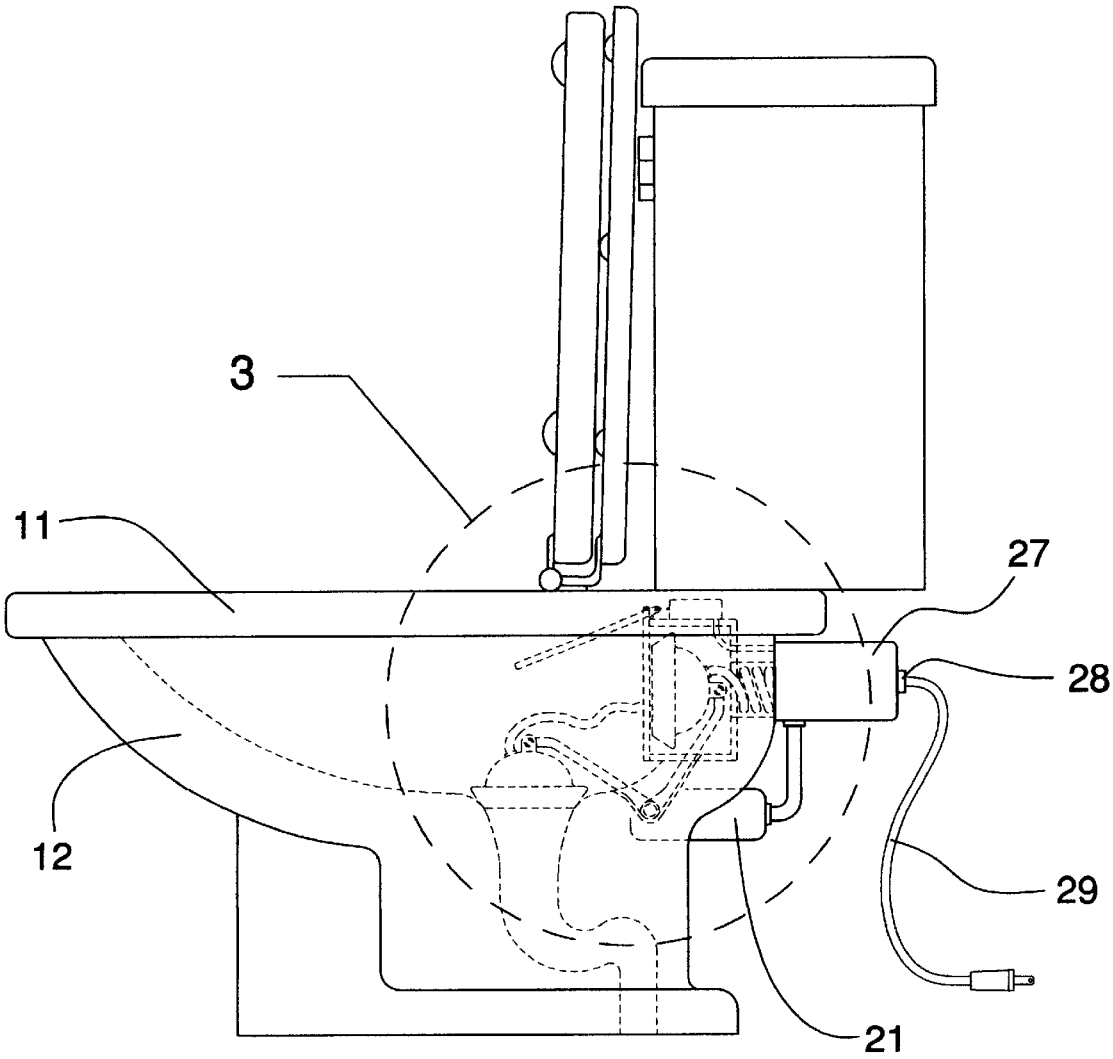
FIG. 2 is a side elevational view of the toilet of the present invention.
Figure 3:
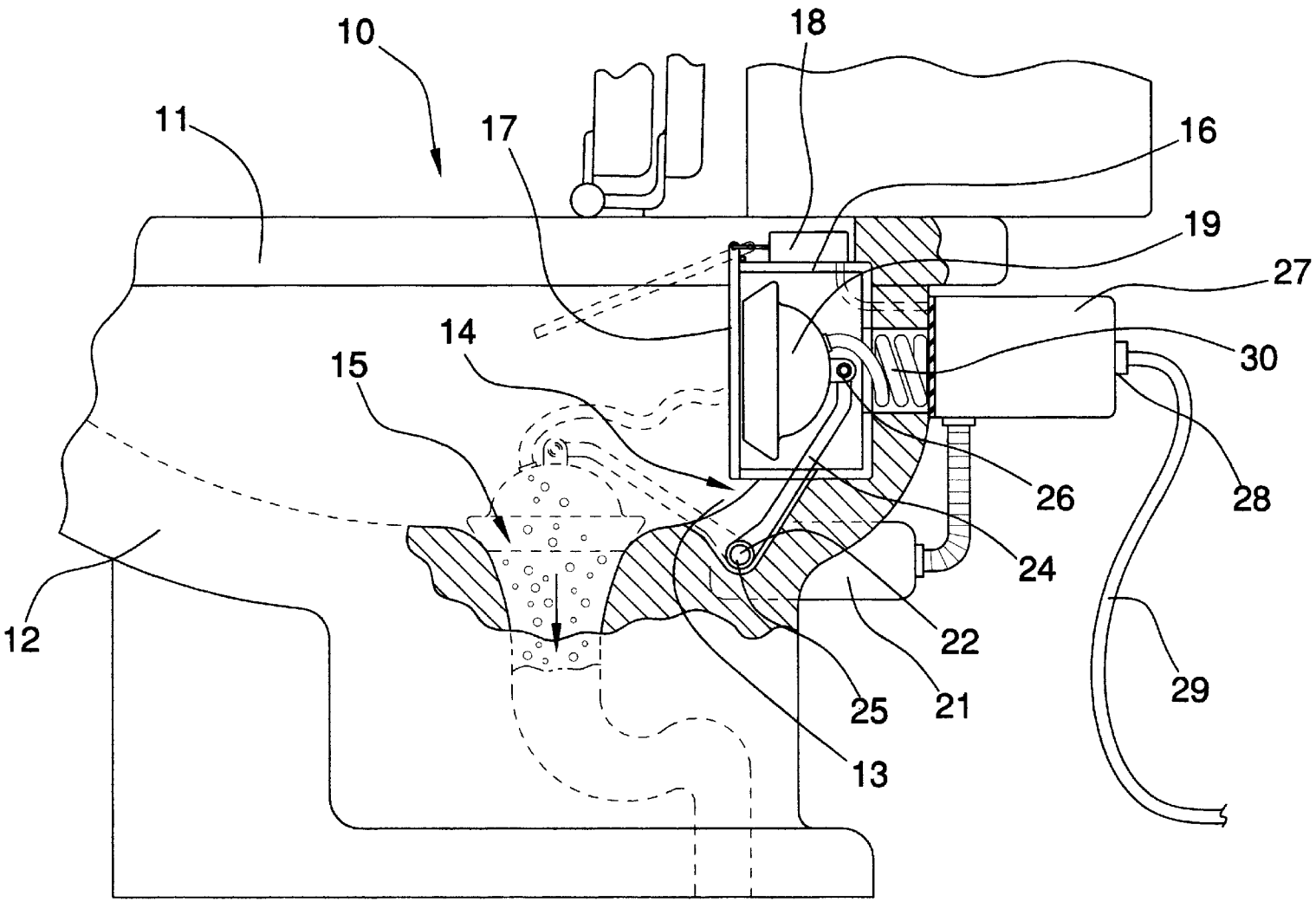
FIG. 3 is a detailed side elevational view of the present invention.
Figure 4:
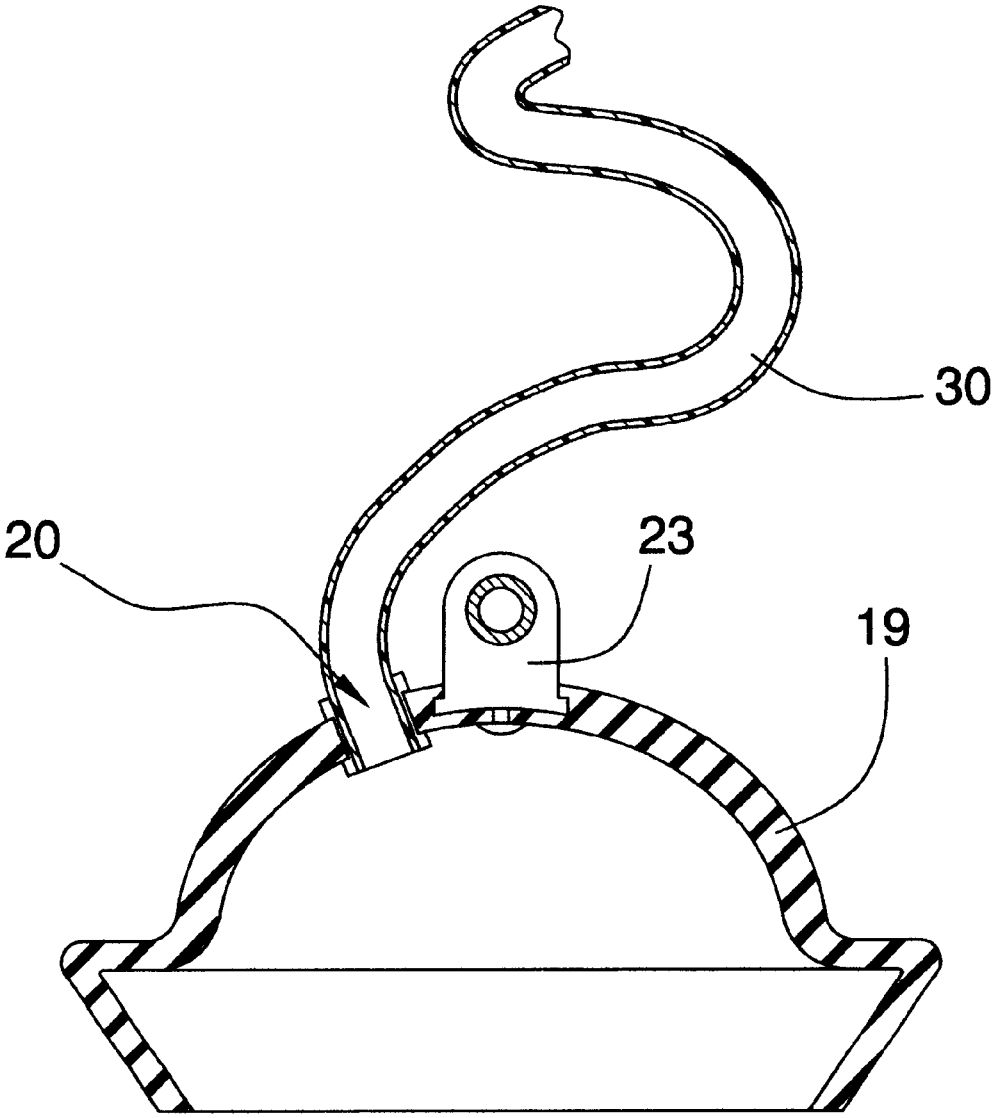
FIG. 4 is a side edge elevational view of the present invention.
Figure 6:
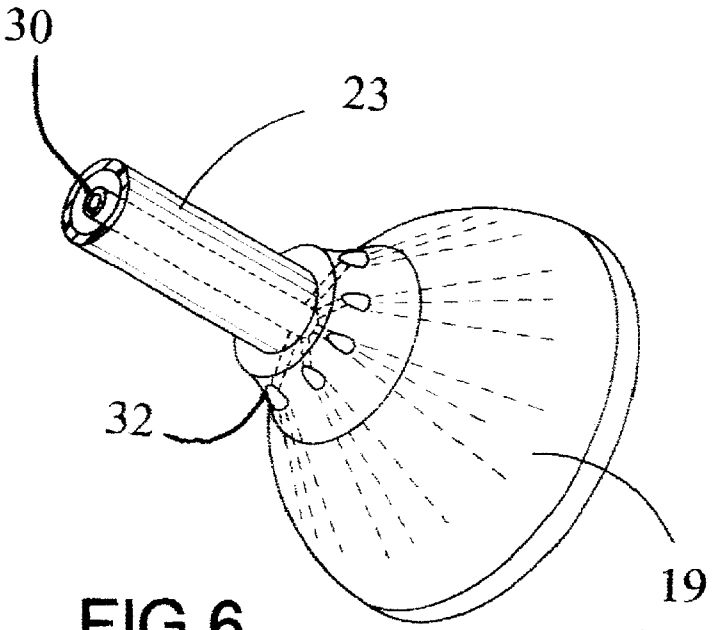
FIG. 6 is a perspective view of a second embodiment of the nozzle, bracket, plunger member and hose of the present invention.
Figure 5:
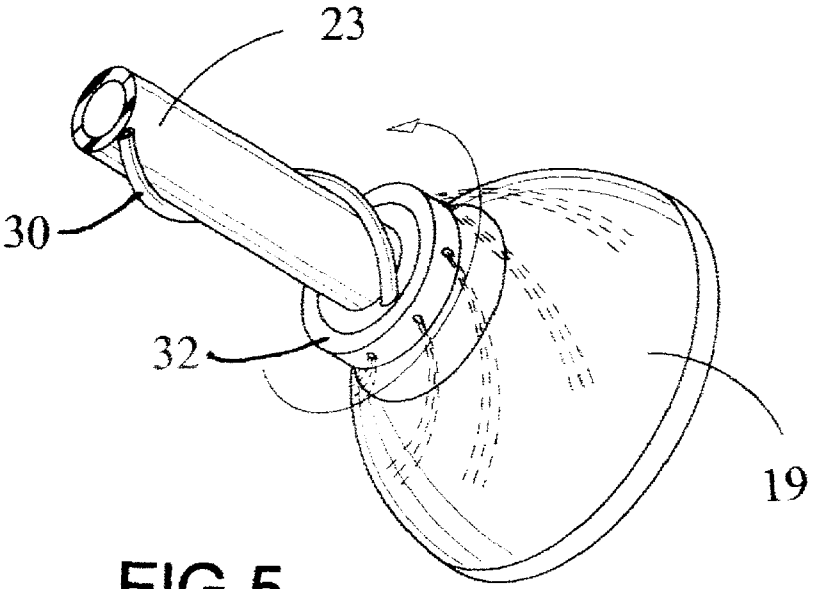
FIG. 5 is a perspective view of the nozzle, bracket, plunger member and hose of the present invention.

With reference now to the drawings, and in particular to FIGS. 1 through 6 thereof, a new automated toilet plunging apparatus embodying the principles and concepts of the present invention and generally designated by the reference numeral 10 will be described.

As best illustrated in FIGS. 1 through 6, the automated toilet plunging apparatus 10 generally comprises a toilet 11 having a bowl 12 and also having a drain 13 disposed through a bottom of the bowl 12. The bowl 12 includes a back wall 14, and also includes a recessed area 15 disposed in the back wall 14.

A plunger housing assembly includes a container 16 being securely and conventionally disposed in the bowl 12 and having an open front side 31, and also includes a door 17 being hingedly and conventionally attached to the container 16 and being openly closed upon the open front side 31 of the container 16. The plunger housing assembly further includes a conventional door opener/closer member 18 being conventionally connected to the door 17 for opening and closing the door 17 and being conventionally attached to the container 16. The container 16 is securely and conventionally disposed in the recessed area 15 of the bowl 12.

A plunger member 19 is removably disposed in the container 16 for opening a plugged drain 13. The plunger member 19 is a rubberized suction cup and has a hole 20 being disposed through a wall thereof. An assembly of actuating the plunger member 19 includes a motor 21 being conventionally attached to the toilet 11 and having a motor shaft 22, and also includes a bracket 23 being conventionally attached to the plunger member 19, and further includes an arm 24 being pivotally and conventionally attached to the bracket 23 and being conventionally connected to the motor 21, and also includes a control unit 27 being conventionally attached to the toilet 11 and being conventionally connected to the motor 21 and to the door opener/closer member 18. The arm 24 has a first end 25 that is securely and conventionally attached to the motor shaft 22 and also has a second end 26 which is conventionally attached to the bracket 23 for positioning the plunger member 19 over the drain 15 and also for removing the plunger member 19 from over the drain 15. The control unit 27 includes power switches 28 for energizing the door opener/closer member 18 and the motor 21, and also includes a power cord 29 being conventionally connected to the power switches 28 and being connectable to a power source.

A cleaner assembly is adapted to be connected to a water supply for rinsing the bowl 12 when the plunger member 19 is positioned over the drain 15, and includes a nozzle 32 being rotatably and conventionally mounted about the bracket 23 and upon the plunger member 19, and further includes a hose 30 which is conventionally attached to the nozzle 32 and to the plunger member 19. The hose 30 has an end that is securely and conventionally attached in the hole 20 of the plunger member 19.

In use, the user would actuate the door opener/closer member 18 and the motor 21 by depressing the power switches 28 which would open the door 17 and would rotate the arm 24 to move the plunger member 19 from in the container 16 to a position over the drain 15 and the second end 26 of the arm 24 would continue to press in upon the wall of the plunger member 19 thus causing a suction in the drain 15 which urges the clogging material from the drain 15 into the bowl 12; whereupon, the user can rinse the bowl 12 by turning on the water supply so that water passes through the hose 30 and through either the nozzle 32 or the plunger member 19 into the bowl 12.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the automated toilet plunging apparatus. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An automated toilet plunging apparatus comprising:

a toilet having a bowl and also having a drain disposed through a bottom of said bowl;

a plunger housing assembly including a container being securely disposed in said bowl and having an open front side, and also including a door being hingedly attached to said container and being openly closed upon said open front side of said container;

a plunger member being removably disposed in said container for opening a plugged said drain;

an assembly of actuating said plunger member; and a cleaner assembly being adapted to be connected to a water supply for rinsing said bowl when said plunger member is positioned over said drain, and including a nozzle being rotatably mounted about a bracket and upon said plunger member, and further including a hose being attached to said nozzle and to said plunger member.

2. An automated toilet plunging apparatus as described in claim 1, wherein said bowl includes a back wall, and also includes a recessed area disposed in said back wall.

3. An automated toilet plunging apparatus as described in claim 2, wherein said plunger housing assembly further includes a door opener/closer member being connected to said door for opening and closing said door and being attached to said container.

4. An automated toilet plunging apparatus as described in claim 3, wherein said container is securely disposed in said recessed area of said bowl.

5. An automated toilet plunging apparatus as described in claim 4, wherein said plunger member is a rubberized suction cup and has a hole being disposed through a wall thereof.

6. An automated toilet plunging apparatus as described in claim 5, wherein said means of actuating said plunger member includes a motor being attached to said toilet and having a motor shaft, and also includes another bracket being attached to said plunger member, and further includes an arm being pivotally attached to said another bracket and being connected to said motor, and also includes a control unit being attached to said toilet and being connected to said motor and to said door opener/closer member.

7. An automated toilet plunging apparatus as described in claim 6, wherein said arm has a first end which is attached to said motor shaft and also has a second end which is attached to said another bracket for positioning said plunger member over said drain and also for removing said plunger member from over said drain.

8. An automated toilet plunging apparatus as described in claim 7, wherein said control unit includes power switches for energizing said door opener/closer member and said motor, and also includes a power cord being connected to said power switches and being connectable to a power source.

9. An automated toilet plunging apparatus as described in claim 8, wherein said hose has an end which is securely attached in said hole of said plunger member.

* * * * *